US005678337A

United States Patent [19]

Ashoori

[11] Patent Number: 5,678,337

[45] Date of Patent: Oct. 21, 1997

[54] THREE-DIMENSIONAL SIGNAGE FOR A HORIZONTAL SURFACE

[76] Inventor: Amir Ashoori, P.O. Box 658, Lynnwood, Wash. 98046-0658

[21] Appl. No.: 543,600

[22] Filed: Oct. 16, 1995

[51] Int. Cl.[6] ..... G09F 7/12

[52] U.S. Cl. ..... 40/594; 404/42; 40/612

[58] Field of Search ..... 40/594, 630, 612; 248/205.3, 205.4; 404/9, 14, 93, 94, 42; 116/63 R; 428/137, 139, 140, 247, 256, 285, 344, 354, 290

[56] References Cited

U.S. PATENT DOCUMENTS

| | | | |
|---|---|---|---|
| 4,427,733 | 1/1984 | Pöll et al. | 428/344 X |
| 4,454,181 | 6/1984 | Hohn | 428/99 X |
| 4,695,508 | 9/1987 | Kageyama et al. | 428/290 X |
| 4,888,896 | 12/1989 | Sanchez | 40/630 |
| 4,971,644 | 11/1990 | Mahn, Sr. et al. | 428/139 X |
| 5,145,729 | 9/1992 | Padden | 428/247 X |
| 5,283,998 | 2/1994 | Jong | 428/344 X |
| 5,308,186 | 5/1994 | Hedgewick | 404/14 |
| 5,310,279 | 5/1994 | Lindner | 404/14 |
| 5,458,938 | 10/1995 | Nygard et al. | 40/594 X |

*Primary Examiner*—Joanne Silbermann
*Attorney, Agent, or Firm*—Christensen O'Connor Johnson & Kindness PLLC

[57] ABSTRACT

The present invention pertains to signage comprised of symbols or indicia that is adapted to be attached to a horizontal surface, such as pavement, asphalt or cement. The signage is comprised of a plurality of separate signage portions, each of which has ends which are spaced apart from the ends of all of the other signage portions to allow liquid to drain from the pavement within the signage portions when the signage portions are attached to the pavement. Some of the ends of the signage portions have only a convex top face and a face that is substantially perpendicular to the pavement, while other signage portions have ends with both a face that is substantially perpendicular to the pavement and an angled face connecting the face that is substantially perpendicular to the pavement to a convex top face of the signage portion that is substantially parallel with the pavement.

20 Claims, 3 Drawing Sheets

THREE-DIMENSIONAL SIGNAGE FOR A HORIZONTAL SURFACE

BACKGROUND OF THE INVENTION

The invention pertains to signage that is attached to a horizontal surface, and more specifically pertains to three-dimensional signage that is attached by adhesive to a horizontal surface such as pavement, asphalt or cement.

It is often necessary to place signage comprised of symbols or indicia on a horizontal surface such as pavement, asphalt or cement, quite often in parking lots, sidewalks, streets, driveways or the like. Examples of such symbols or indicia include the handicapped person symbol, the letters of the alphabet A through Z, the digits 0 through 9, and road sign symbols. Traditionally, these symbols or indicia have been applied to pavement, asphalt or cement in a two-dimensional manner by, for example, painting. However, two-dimensional marking suffers from reduced visibility at distances, is readily covered or obscured by dirt, and often wears relatively quickly.

Three-dimensional symbols or indicia are generally known, but suffer from numerous deficiencies. When of unitary construction, water or other liquid will collect on the portion of the pavement, asphalt or cement surrounded by some of these symbols or indicia (i.e., the center portion of the letter A or O), which can result in partial obstruction of the symbol or indicia as well as increase the rate of water damage at the point of attachment of the symbol or indicia to the pavement, asphalt or concrete. Additionally, minute cracks or crevices formed in weakened joint locations of the unitary symbol or indicia provide ideal locations for dirt, mud, oil, grease, ice or other foreign matter that results in additional wear and tear and will ultimately separate the signage from the pavement, asphalt or cement. Furthermore, many of the known three-dimensional symbols or indicia have sharp edges or corners which readily damage automobile tires as well as providing points of weakness which are subject to cracking and breaking as vehicles traverse the signage. However, other symbols or indicia having adjacent rounded edges or corners, while not as likely to puncture car tires or to break, provide prime locations for the collection of dirt, mud, grease, ice or other like.

A need thus exists for signage for a horizontal surface comprised of a plurality of separate signage portions.

A need also exists for the above type of signage wherein the ends of each of the signage portions are spaced apart from the ends of all of the other signage portions to allow liquid to drain from the pavement, asphalt or cement within the signage portion.

A need further exists for the above type of signage wherein at least some of the ends of the signage portions have both a face substantially perpendicular to the pavement, asphalt or cement and an angled face connecting the face perpendicular to the pavement, asphalt or cement with a convex top face such that sharp corners are absent to avoid damage to vehicle tires and to the signage portion while providing a spacing between signage portions which minimizes the amount of dirt, grease, mud, ice and other foreign matter lodged between adjacent signage portions.

A need finally exists for the above type of signage wherein an adhesive trap is secured to the underside of the signage portions in order to contain adhesive between the underside of the signage portion and the trap as well as between the trap and the pavement, asphalt or cement to which the signage is adhesively bonded.

SUMMARY OF THE INVENTION

The present invention pertains to signage comprised of symbols or indicia that is adapted to be attached to a horizontal surface, such as pavement, asphalt or cement. The signage is comprised of a plurality of separate signage portions, each of which has ends which are spaced apart from the ends of all of the other signage portions to allow liquid to drain from the pavement within the signage portions when the signage portions are attached to the pavement. Some of the ends of the signage portions have only a face that is substantially perpendicular to the pavement and a convex top face, while other signage portions have ends with both a face that is substantially perpendicular to the pavement and an angled face connecting the face that is substantially perpendicular to the pavement to a convex top face of the signage portion that is substantially parallel with the pavement.

Preferably, adhesive traps are secured to the underside of each of the signage portions. Each of the adhesive traps has at least a pair of legs that are at least partially embedded in the underside of one of the signage portions. The adhesive traps each also have a planar body spaced from the underside of the signage portion by the pair of legs such that adhesive is located between the underside of the signage portion and the planar body of the trap as well as between the planar body of the trap and the horizontal surface to which the signage portion is secured by the adhesive.

Most preferably, the signage portions are comprised of a synthetic polymer and the adhesive traps are metal. The adhesive traps each most preferably include a plurality of orifices for the passage of adhesive therethrough, and the adhesive traps have serrated edges on the legs thereof. The signage portions each have a height of between about ½ of an inch and about ¾ of an inch in order to maximize visibility of the signage portions when attached to the horizontal surface.

BRIEF DESCRIPTION OF THE DRAWINGS

These and other features of the present invention will be more fully appreciated when considered in light of the following specification and drawings in which.

DETAILED DESCRIPTION OF THE PREFERRED EMBODIMENTS

Referring to FIGS. 1 through 6, the present invention is three-dimensional signage for a horizontal surface. The three-dimensional signage of the present invention includes, for example, symbols or indicia such as the handicapped person symbol, maternity symbol, the letters of the alphabet A through Z, the digits 0 through 9, and road symbols. The horizontal surface on which these symbols or indicia can be applied are, for example, pavement, asphalt or cement. It is to be noted that, in FIGS. 1 through 6, a handicapped person symbol is shown, but the handicapped person symbol is only exemplary, and is not intended to limit the scope of the subject application.

Figure 1:
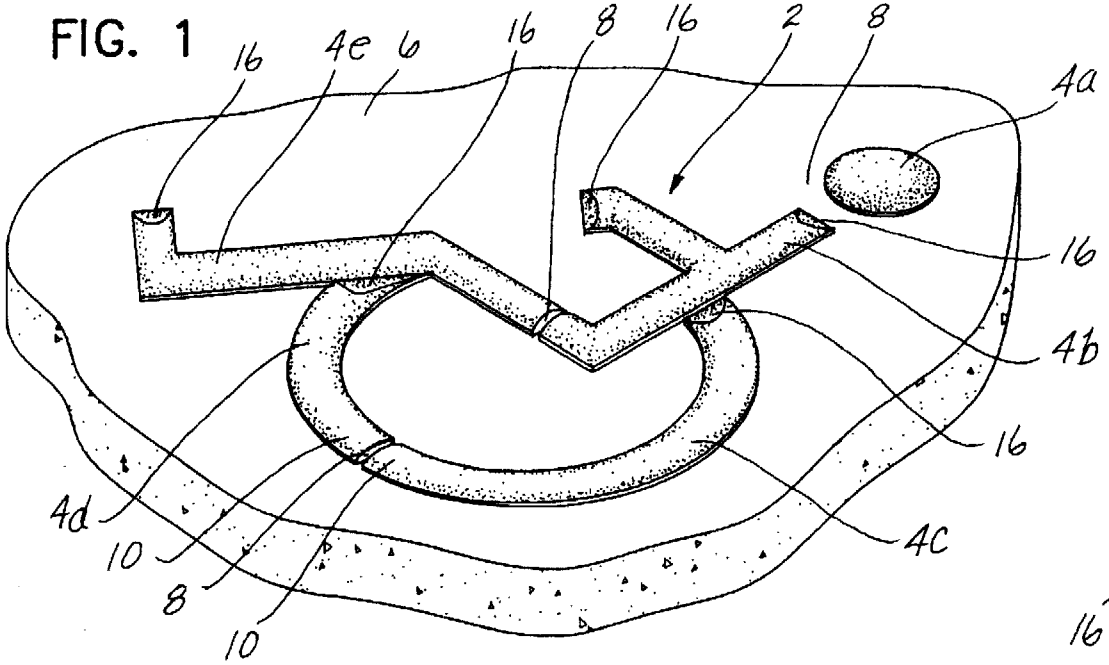
FIG. 1 is an isometric view of the three-dimensional signage of the present invention.
Figure 3:
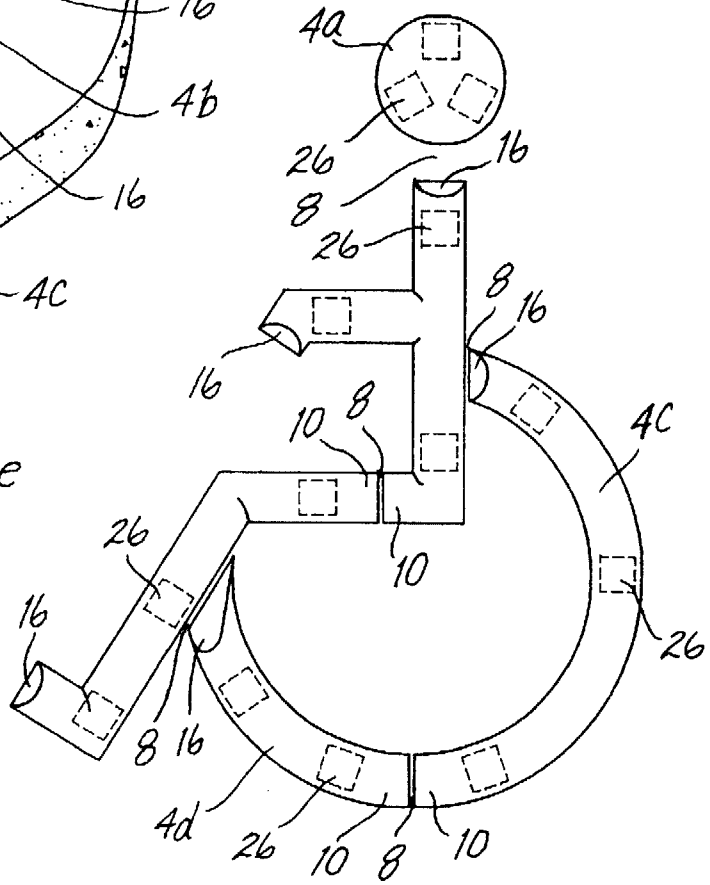
FIG. 3 is a top view of the three-dimensional signage of the present invention.
Figure 2:
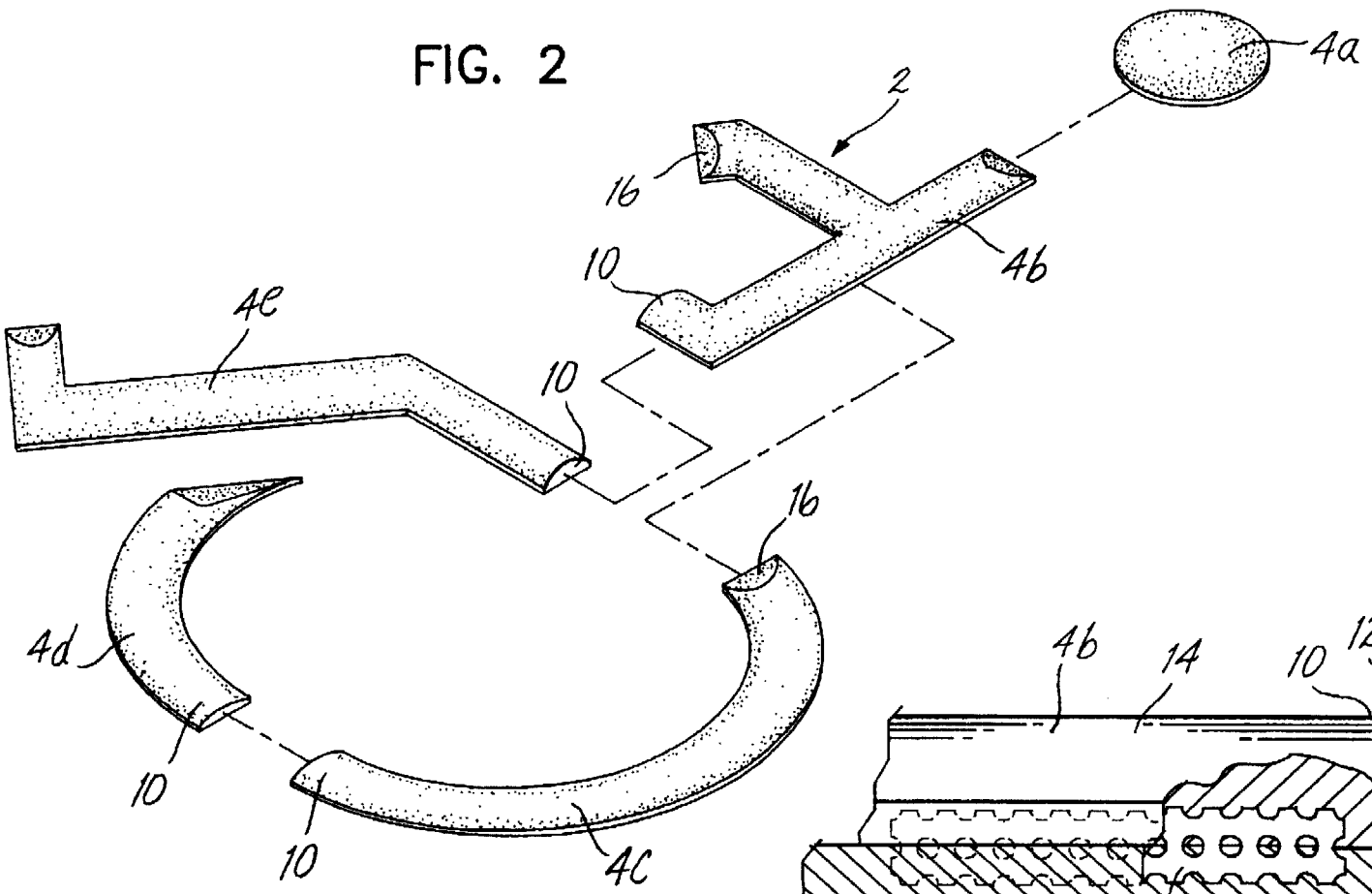
FIG. 2 is an exploded view of the three-dimensional signage of the present invention.

Referring first to FIGS. 1 and 2, three-dimensional signage 2 is comprised of a plurality of signage portions, in this example signage portions 4*a* through 4*e*. Signage portions 4*a* through 4*e* are attached to horizontal surface 6 in a manner to be described in detail below. Signage portions 4*a* through 4*e* preferably have a height of between about ½ inch and about ¾ inch such that three-dimensional signage 2 is clearly visible to the observer when attached to horizontal surface 6. This height, which constitutes the three-dimensional nature of three-dimensional signage 2 also functions to notify a driver of a vehicle of the presence of three-dimensional signage 2 when the vehicle tire passes over three-dimensional signage 2.

As shown in FIGS. 1, 2, 3 and 5, signage portions 4*a* through 4*e*, when affixed to surface 6 to form three-dimensional signage 2, do not contact each other but are separated by spaces 8. Spaces 8 allow water drainage to occur between signage portions 4*a* through 4*e* such that the portions of horizontal surface 6 that otherwise would be totally surrounded by signage portions 4*a* through 4*e* do not suffer from an increased rate of water damage to the point of attachment of signage portions 4*a* through 4*e* to horizontal surface 6 since no water build-up occurs.

Figure 5:
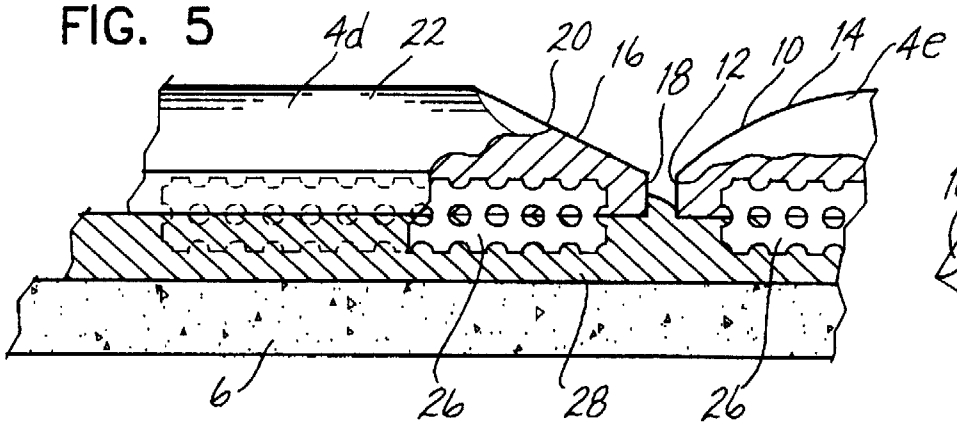
FIG. 5 is a side view, partially exposed, of two signage portions of the three-dimensional signage of the present invention having adhesive traps attached thereto and embedded in adhesive on a horizontal surface.
Figure 7:
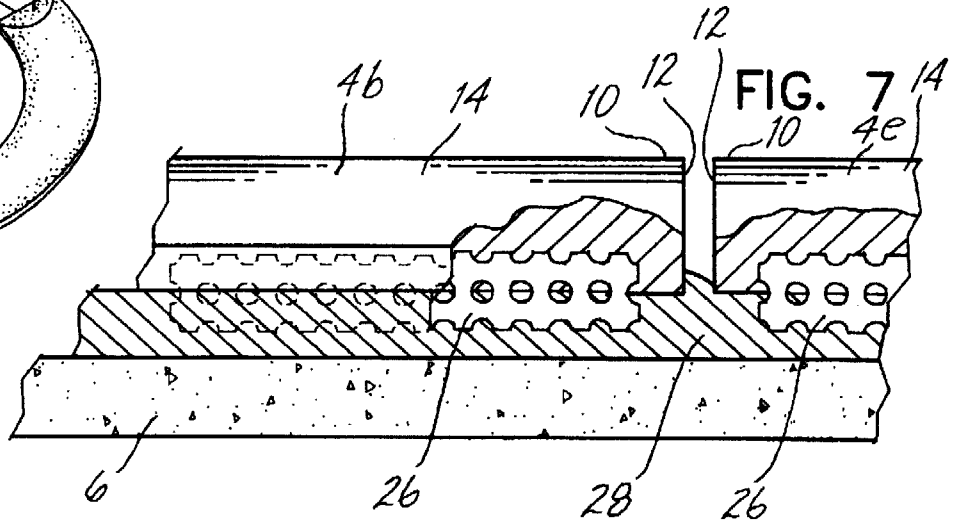
FIG. 7 is a side view, partially exposed, of two signage portions of the three-dimensional signage of the present invention having adhesive traps attached thereto and embedded in adhesive on a horizontal surface.
Figure 4:
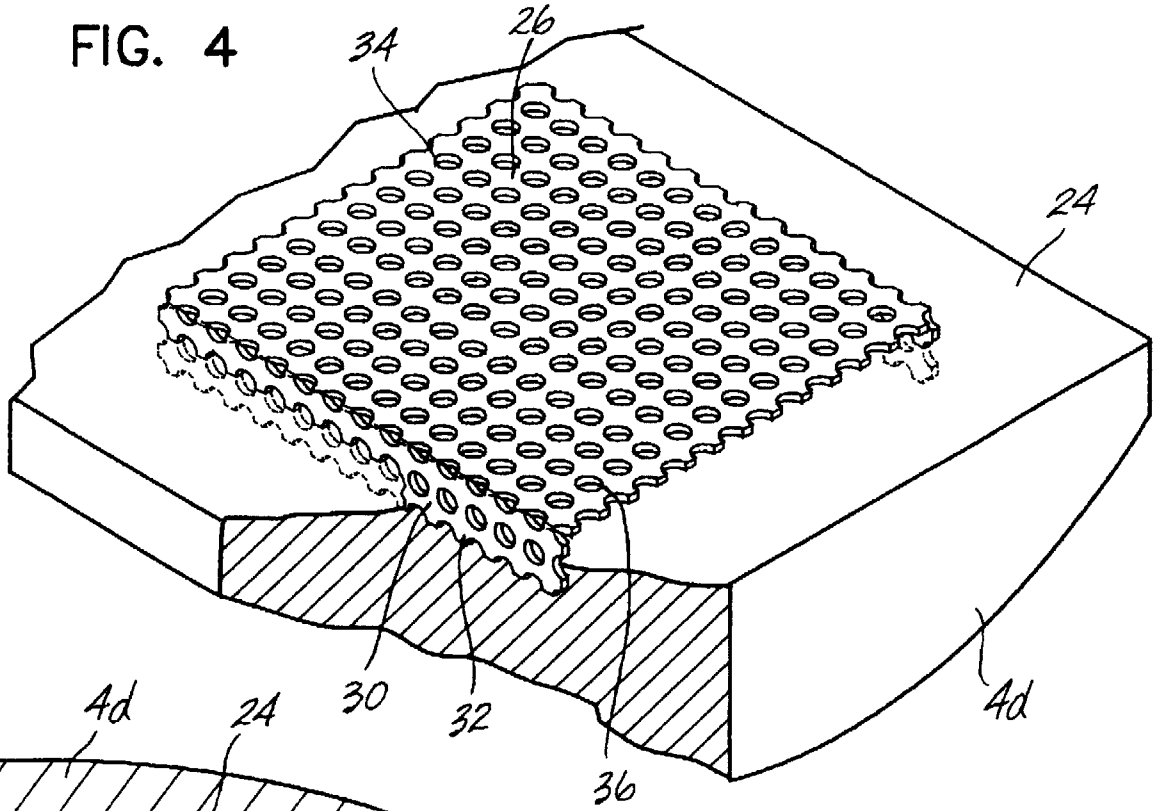
FIG. 4 is a perspective view of the underside of the three-dimensional signage of the present invention, showing the adhesive trap.

FIGS. 5 and 7 show in detail the location of space 8 between signage portions 4*d* and 4*e* (or between 4*b* and 4*c*), and between signage portions 4*b* and 4*e* (or between 4*c* and 4*d*), respectively, that allows water to drain therebetween. FIG. 5 also shows in detail the two types of ends present in signage portions 4*a* through 4*e*. More specifically, signage portion 4*e* of FIG. 5 has a flat end (or side) 10 having perpendicular face 12; perpendicular face 12 is substantially perpendicular to horizontal surface 6. Perpendicular face 12 is joined to convex top face 14 which is substantially parallel with horizontal surface 6. In contrast, signage portion 4*d* has beveled end 16 having perpendicular face 18 which is joined to angled face 20, which, in turn, is joined to convex top face 22. Perpendicular face 18 is substantially perpendicular to horizontal surface 6. The orientation of beveled end 16 adjacent to flat end (or side) 10, separated by space 8, minimizes damage to vehicle tires, which may drive over three-dimensional signage 2, due to the presence of angled face 20 because angled face 20 does not have a sharp corner which may puncture vehicle tires. Additionally, angled face 20 minimizes the damage to signage portions 4*a* through 4*e* when vehicles drive over signage portions 4*a* through 4*e* because the vehicle tire is contacting a flattened, or angled face as opposed to a sharp corner which is more likely to crack or chip off. Moreover, the presence of angled face 20 reduces the depth of space 8, thus making space 8 more accessible to cleaning devices such as street sweepers, which minimizes the amount of dirt, grit and grime which cannot be removed from space 8. Furthermore, angled face 20 also minimizes the amount of dirt, grit and grime which settles in space 8 initially because the effective depth of space 8 has been minimized by the presence of angled face 20. FIG. 7 shows signage portions 4*b* and 4*e*, each having a flat end 10 with a perpendicular face 12 and separated by space 8, instead of one of signage portions 4*b* or 4*e* having a bevelled end 16 with a perpendicular face 18 and an angled face 20 as in FIG. 5.

Figure 6:
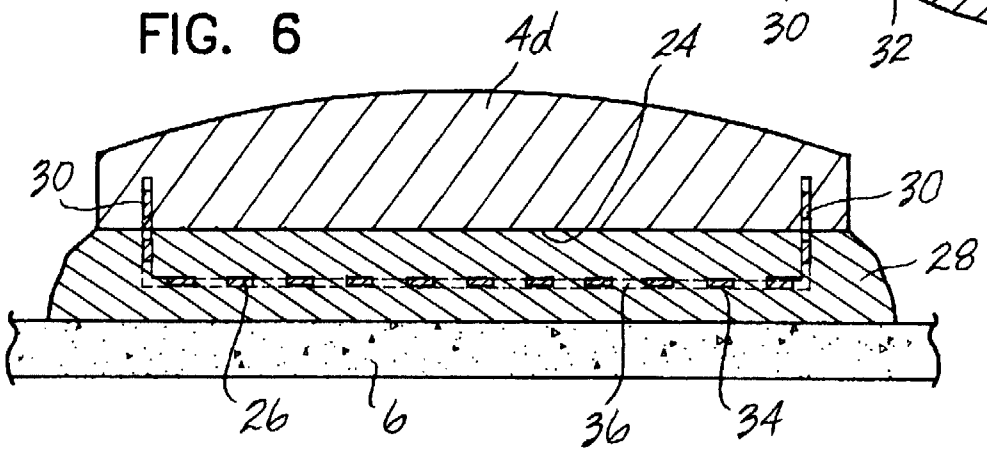
FIG. 6 is an exposed end view of a signage of the three-dimensional signage of the present invention having an adhesive trap attached thereto and embedded in adhesive on a horizontal surface.

Now referring to FIGS. 3 through 6, signage portions 4*a* through 4*e* include an underside 24 in which one or more adhesive traps 26 are partially secured. As discussed in more detail below, adhesive traps 26 are secured on the underside 24 of signage portions 4*a* through 4*e* during, or just prior to, the curing, or drying process of the manufacture of three-dimensional signage 2. Adhesive traps 26 are optionally employed in the attachment of signage portions 4*a* through 4*e* to surface 6 with an adhesive 28 by increasing the surface area of three-dimensional signage 2 to which adhesive 28 can adhere, and by functioning as an anchor. Adhesive traps 26 include legs 30 which are partially embedded in underside 24 of signage portions 4*a* through 4*e*. Legs 30 preferably have serrated edges 32 which aid in the penetration of legs 30 of adhesive trap 26 into the underside 24 of signage portions 4*a* through 4*e* as signage portions 4*a* through 4*e* cure or dry. Adhesive traps 26 also include planar body 34 which joins each one of legs 30 to the other. Adhesive trap 26 includes a plurality of orifices 36 therethrough, which ensure that adhesive 28 can migrate through planar body 34 and legs 30 of adhesive trap 26 when signage portions 4*a* through 4*e* are placed in adhesive 28 on horizontal surface 6. As best shown in FIG. 6, adhesive trap 26 allows adhesive 28 to contact not only underside 24 of signage portions 4*a* through 4*e*, but also to contact legs 30 and planar body 34 of adhesive trap 26 as well as surface 6. Thus, the surface area of three-dimensional signage 2 that is being contacted by adhesive 28 has been increased, with adhesive trap 26 acting as an anchor within adhesive 28.

The manufacture of three-dimensional signage 2 will now be described in detail. Three-dimensional signage 2 is preferably manufactured by combining a resin, such as polyester resin (for example, "S41", comprised of a styrene monomer, unsaturated polyester resin and silicon dioxide, supplied by Silmar, 12335 South Van Ness Avenue, Hawthorne, Calif. 90251), with a filler, such as aluminum trihydroxide or calcium carbonate (supplied by Georgia Marble Company, 2575 Northwest Cumberland Parkway, Atlanta, Ga. 30339). Signage portions 4*a* through 4*e* are fabricated by casting the resin and filler combination in an open mold system. A catalyst, such as a combination of, for example, methyl ethyl ketone peroxide and dimethyl phthalate ("NOROX MEKP-9" supplied by Norac Company, Inc., 405 South Motor Avenue, Azusa, Calif. 91702), is employed in the reaction. Optionally, a pigment can be included such as, for example, titanium dioxide ("TIONA RCL-9" supplied by SCM Chemicals, 3901 Glidden Road, Baltimore, Md. 21226). Also, an ultra-violet protectant known in the art can be added. The preferred percentages of the resin, filler, pigment, catalyst and ultraviolet protectant are shown in Table 1.

TABLE 1

| | |
|---|---|
| Resin | 44.20 ± 2% |
| Filler | 40.69 ± 2% |
| Pigment | 11.62 ± 2% |
| Catalyst | 3.48 ± 2% |
| Ultra-violet protectant | 0.01% |

The constituents of Table 1 are blended thoroughly and poured into an open mold of the desired shape. The mixture forms a gel, at which time adhesive traps 26 can be attached to underside 24 of signage portions 4*a* through 4*e* by pressing legs 30 partially into underside 24. After the exothermic reaction is completed, signage portions 4*a* through 4*e* will solidify. They are then removed from the molds and a top coat of clear resin known in the art is added for additional protection against dirt and oil. Signage portions 4*a* through 4*e* are then cured by being subjected to additional heat of about 190° F. for about 220 minutes. Signage portions 4*a* through 4*e* are then bonded to horizontal surface 6 by means of adhesive 28. Adhesive 28 is preferably a two-part epoxy adhesive system. The adhesive bond is initially cured within one hour and reaches its fully cured state within 72 hours. Adhesive 28 can be, for example, "EAS-6" supplied by QCM, 930 South Central, Kent, Wash. 98032.

While particular embodiments of the present invention have been described in some detail herein above, changes and modifications may be made in the illustrated embodiments without departing from the spirit of the invention.

I claim:

1. Signage providing symbols or indicia and adapted to be attached to a horizontal surface such as pavement, asphalt, or cement comprising:

a plurality of separate signage portions, each of said signage portions having ends, said ends of each of said signage portions being spaced from said ends of all of the other of said signage portions to allow liquid to drain from the horizontal surface within said signage portions when attached to the horizontal surface, a first number of said ends having only a convex top face and a face that is substantially perpendicular to the horizontal surface and a second number of said ends having both a face that is substantially perpendicular to the horizontal surface and an angled face connecting said face that is substantially perpendicular to the horizontal surface to a convex top face of said signage portion that is substantially parallel with the horizontal surface, each of said signage portions having an underside; and adhesive traps secured to said underside of each of said signage portions, each of said adhesive traps having at least a pair of legs at least partially embedded in one of said signage portions and a planar body spaced from said underside of said signage portion such that adhesive is located between said underside of said signage portion and said planar body of said adhesive trap as well as between said planar body of said adhesive trap and the horizontal surface to which said signage portion is secured by adhesive.

2. The signage of claim 1 wherein said signage portions are comprised of a synthetic polymer.

3. The signage of claim 1 wherein said adhesive traps are metal.

4. The signage of claim 1 wherein said adhesive traps each include a plurality of orifices for the passage of adhesive therethrough.

5. The signage of claim 1 wherein said adhesive traps have serrated edges on said legs.

6. The signage of claim 1 wherein each of said signage portions has a height of between about ½ of an inch and about ¾ of an inch for visibility.

7. Signage providing symbols or indicia and adapted to be attached to a horizontal surface such as pavement, asphalt, or cement comprising:

a plurality of separate signage portions together forming a recognizable symbol or indicia, each of said signage portions having ends, said ends of each of said signage portions being spaced from said ends of all of the other of said signage portions to allow liquid to drain from the horizontal surface within said signage portions when attached to the horizontal surface, a first number of said ends having only a convex top face and a face that is substantially perpendicular to the horizontal surface and a second number of said ends having a face that is substantially perpendicular to the horizontal surface and at least one angled face forming a planar or convex connection between said face that is substantially perpendicular to the horizontal surface and a convex top face of said signage portion that is substantially parallel with the horizontal surface, each of said signage portions having an underside.

8. The signage of claim 7 further comprising:

adhesive traps secured to said underside of each of said signage portions, each of said adhesive traps having at least a pair of legs at least partially embedded in one of said signage portions and a planar body spaced from said underside of said signage portion such that adhesive is located between said underside of said signage portion and said planar body of said adhesive trap as well as between said planar body of said adhesive trap and the horizontal surface to which said signage portion is secured by adhesive.

9. The signage of claim 8 wherein said adhesive traps are metal.

10. The signage of claim 8 wherein said adhesive traps each include a plurality of orifices for the passage of adhesive therethrough.

11. The signage of claim 8 wherein said adhesive traps have serrated edges on said legs.

12. The signage of claim 7 wherein said signage portions are comprised of a synthetic polymer.

13. The signage of claim 7 wherein each of said signage portions has a height of between about ½ of an inch and about ¾ of an inch for visibility.

14. Signage providing symbols or indicia and adapted to be attached to a horizontal surface such as pavement, asphalt, or cement comprising:

a plurality of separate signage portions, each of said signage portions having ends, said ends of each of said signage portions being spaced from said ends of all of the other of said signage portions to allow liquid to drain from the horizontal surface within said signage portions when attached to the horizontal surface, each of said signage portions having an underside; and adhesive traps secured to said underside of each of said signage portions, each of said adhesive traps having at least a pair of legs at least partially embedded in one of said signage portions and a planar body spaced from said underside of said signage portion such that adhesive is located between said underside of said signage portion and said planar body of said adhesive trap as well as between said planar body of said adhesive trap and the horizontal surface to which said signage portion is secured by adhesive.

15. The signage of claim 14 wherein a first number of said ends of said signage portions have only a convex top face and a face substantially perpendicular to the horizontal surface and a second number of said ends have both a face that is substantially perpendicular to the horizontal surface and an angled face connecting said face that is substantially perpendicular to the horizontal surface to a convex top face of said signage portion that is substantially parallel with the horizontal surface.

16. The signage of claim 14 wherein said signage portions are comprised of a synthetic polymer.

17. The signage of claim 14 wherein said adhesive traps are metal.

18. The signage of claim 14 wherein said adhesive traps each include a plurality of orifices for the passage of adhesive therethrough.

19. The signage of claim 14 wherein said adhesive traps have serrated edges on said legs.

20. The signage of claim 14 wherein each of said signage portions has a height of between about ½ of an inch and about ¾ of an inch for visibility.

* * * * *